United States Patent [19]

Langerbeck

[11] Patent Number: 4,467,573

[45] Date of Patent: Aug. 28, 1984

[54] CONTAINER FOR AN INDUSTRY HALL

[75] Inventor: Fritz Langerbeck, Malmö , Sweden

[73] Assignee: Kjessler & Mannerstrale AB., Malmö , Sweden

[21] Appl. No.: 321,179

[22] PCT Filed: Feb. 28, 1981

[86] PCT No.: PCT/EP81/00017

§ 371 Date: Nov. 9, 1981

§ 102(e) Date: Nov. 9, 1981

[87] PCT Pub. No.: WO81/02599

PCT Pub. Date: Sep. 17, 1981

[30] Foreign Application Priority Data

Mar. 7, 1980 [SE] Sweden ..... 8001790

[51] Int. Cl.[3] ..... E04B 1/343

[52] U.S. Cl. ..... 52/79.5; 52/69; 52/71; 52/79.1

[58] Field of Search ..... 52/69, 71, 79.5, 79.1

[56] References Cited

U.S. PATENT DOCUMENTS

| | | | |
|---|---|---|---|
| 2,260,369 | 10/1941 | Ebenhack | 52/69 |
| 4,245,439 | 1/1981 | Flaba | 52/71 |

FOREIGN PATENT DOCUMENTS

| | | | |
|---|---|---|---|
| 1086986 | 2/1968 | France | 52/69 |
| 0042757 | 1/1959 | Poland | 52/71 |
| 215581 | 9/1967 | Sweden | 52/69 |
| 2029474 | 3/1980 | United Kingdom | 52/71 |

*Primary Examiner*—John E. Murtagh
*Assistant Examiner*—Richard E. Chilcot, Jr.
*Attorney, Agent, or Firm*—Ladas & Parry

[57] ABSTRACT

A container for an industry hall which can be assembled to an industry hall or similar and alternatively to a package or container, which fulfils the international regulations concerning dimensions and strength. The roof support member of the industry hall consists of two interconnected roof support beams (4). Each roof support beam has an upper (5) and a lower (6) longitudinal girder. Two roof support beams (4) are interconnected having respective upper longitudinal girder (5) abutting each other, thereby forming a rectangular composite frame 8. This rectangular composite frame forms side surfaces and the outer boundary of the container. Two such rectangular composite frames are placed alongside and spaced from each other and are interconnected by means of mounting beams (7). The remaining parts of the industry hall are placed in a suitable way inside the frame of the container formed in this way.

4 Claims, 9 Drawing Figures

CONTAINER FOR AN INDUSTRY HALL

The present invention relates to the building of an industry hall, a storehouse, a sport hall, an aeroplane hangar, a service hall and similar buildings, which are to be erected at a great distance from the manufacturing factory. The expression industry hall as used in the specification below comprises the above-mentioned different types of buildings as well as other similar buildings.

In order to make possible a simple transport of the integral parts of the industry hall, the parts are according to the present invention packed together into a package, which fulfils the international container regulations as faras dimension and strength are concerned. All parts for the industry hall can be contained within the boundary of the package, which can be transported in a conventional way.

According to the present invention the package is built by the roof support beams of the industry hall, which form the outer shell or frame of the container.

In view of the international regulations a container should have a length of about 12 m(or 9 m). A suitable width of span for a roof support member in the industry hall is 24 m. By the expression roof support member is meant a support composite frame, which spans between two in line mounted main uprights. The roof support member consists of two roof support beams, which are in-line with each other and joined together at the ridge of the roof. The length of the industry hall determines the numbers of roof support member required for the building.

The problem of producing a transportable unit for the parts needed for an industry hall or a house has previously been observed and solved, confer Norwegian patent specification No. 92215. The drawback with this previously known system is that it lacks flexibility, as one is bound to exactly the size of house which is projected. The advantage of the present invention is that the package is built by the roof support beams which are always required in an industry hall while the remaining parts are optional. Thereby a great flexibility is achieved.

According to the present invention two roof support beams, which in the industry hall form a roof support member, are mounted together next to each other in order to form a rectangular composite frame having half the length of the roof support member, i.e. 12 m. Two such mounted composite frames form two side surfaces of the container. The distance between these rectangular composite frames is maintained by means of mounting members, which are used in the industry hall in order to connect together the roof beams at the ridge of the roof.

The present invention discloses a package for transport of components of a hall. The hall contains at least four roof support beams 4, four gable beams 2 and eight mounting members 7. The root support beams 4 being interconnected in pairs and in parallel in order to form at least two rectangular composite frames 8. In this arrangement the upper and lower long side of each rectangular composite frame a gable beam 2 is connected in such a manner that each gable beam includes a number of mounting ears 9 with mounting holes 10. The mounting members 7 consist, of beams with mounting holes 11. Such mounting members 7 are connected with the mounting ears 9 of the gable beams 2 and are transversally directed perpendicular to the rectangular composite frames 8. The mounting members 7 of two spaced parallel rectangular composite frames face and overlap each other and are interconnected in such a way that the two rectangular composite frames are positioned at a predetermined distance from each other and form the side surfaces of a rectangular container. The dimensions of the container correspond to the dimensions according to the international regulations for a transport container.

The present invention also discloses a method of packaging for transport of components of a hall comprising at least four roof support beams 4, each having a lower, essentially horizontal girder 6 and an upper, inclined girder 5, two of the roof support beams 4 in use being mounted together in line with each other by means of mounting members 7 to form a composite roof support member. In this arrangement two roof support beams 4 are mounted together to form a rectangular package, with the upper longitudinal girders 5 placed adjacent each other to form a rectangular composite frame 8. At least two of the composite frames 8 are connected in parallel relationship spaced from each other by means of the mounting members 7 in order to form two side walls of the package. The remaining components of the hall are placed and fixed in the space between the two side walls of the package.

For the purpose of examplification a preferred embodiment of the invention is described below with reference to the accompanying drawing.

Figure 1:
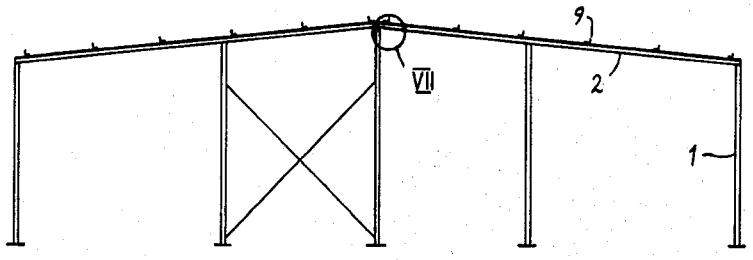
FIG. 1 shows schematically a gable side of an industry hall according to the invention.
Figure 2:
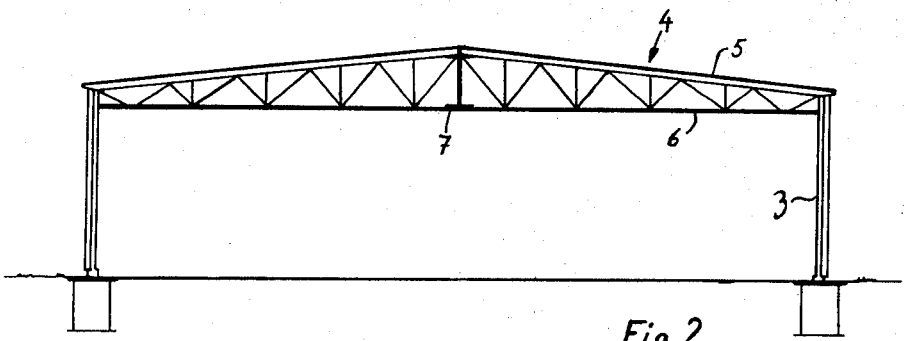
FIG. 2 is a cross-section through the industry hall.

FIGS. 1 and 2 schematically show an industry hall according to the present invention. FIG. 1 shows a gable side, which comprises wall uprights 1 of different length, and two gable beams 2 for the roof. FIG. 2 shows a cross-section through the industry hall with main uprights 3 and roof support beams 4. FIG. 2 shows two roof support beams 4 mounted together at the centre and resting on two main uprights 3. Each roof support beam 4 consists of an upper 5 and a lower 6 longitudinal girder and intermediate vertical and diagonal girders. The lower longitudinal girder 6 is essentially horizontal and the upper longitudinal girder 5 forms an angle with the longitudinal girder 6 in order to give the roof a suitable drainage inclination. The two roof support beams 4 are mounted together at the centre by means of mounting members 7, which are shown in detail in FIG. 9. The main uprights 3 are in any suitable way connected with cement blocks, anchored in the ground.

When transporting the industry hall from the manufacturing factory to the building ground, all parts for the building of the industry hall are package within the boundary of a container, which fulfils the international regulations for containers in respect of dimensions and strength. Thus a container should have a width of 2435 mm +3, −2 mm, a height of 2410 mm ±10 mm and a length of 12187 mm ±5 mm. There is also a container size with e.g. the length of 9 m.

Figure 3:
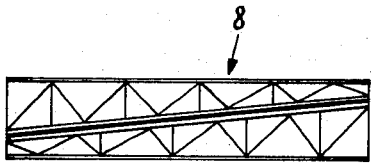
FIG. 3 shows two roof support beams mounted together to form a rectangular composite frame.
Figure 4:
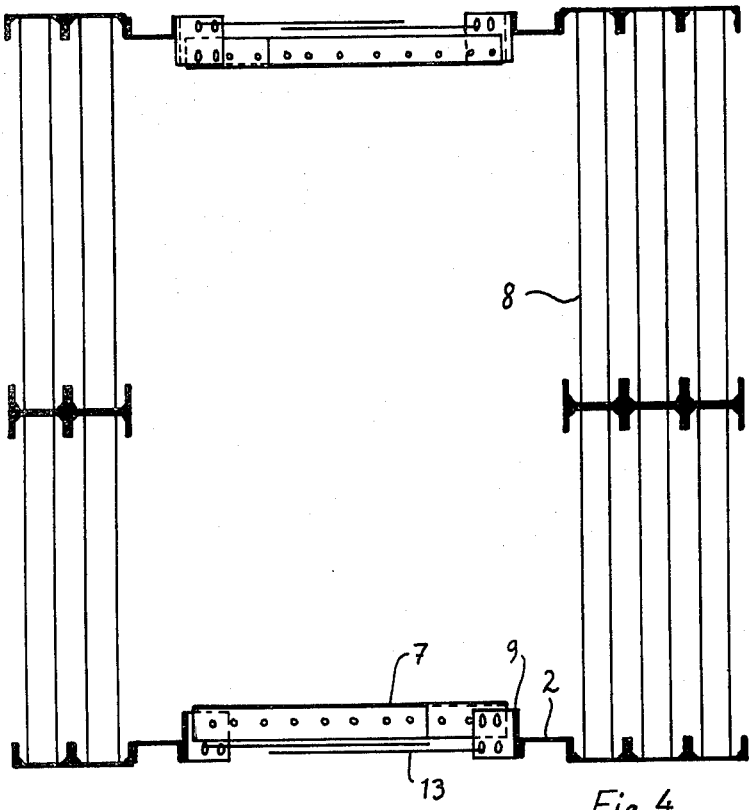
FIG. 4 shows a section of a package mounted according to the invention.

According to the present invention the roof support beam 4 is dimensioned to form a long side of such a container. Thereby the roof support member is divided at the connection area adjacent the ridge of the roof and two roof support beams 4 are mounted together as shown in FIG. 3 having respectively upper longitudinal girder 5 placed adjacent each other and connected to each other by bolts. Each roof support beam 4 is manufactured with a length of 12187 mm. Two roof support beams of this kind mounted together form a rectangular composite frame 8 and two such frames are arranged beside each other at a distance from each other corresponding to the width of the container and are connected with each other by means of the above-mentioned mounting members 7, as can be seen in FIG. 4. Several of rectangular composite frames 8 may form each side of the container, which is also shown in FIG. 4.

Figure 7:
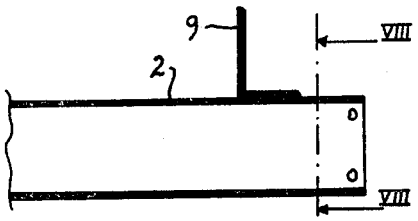
FIG. 7 is a detail enlargement according to the line VII of FIG. 1.

Each industry hall comprises four gable beams 2, which are mounted inside respectively rectangular composite frame 8. Each gable beam comprises L-shaped mounting ears 9 as can be seen in FIGS. 7 and 8.

Figure 8:
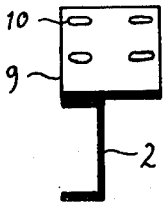
FIG. 8 is a cross-section taken along the line VIII-VIII of FIG. 7.

In the embodiment shown the gable beam 2 consists of a U-profile as is shown in FIG. 8. On the U-profile, L-shaped mounting ears 9 are equidistantly welded as is shown in FIGS. 1 and 7. The mounting ears 9 comprise four elongated holes 10 for connection of the roof material.

Figure 9:
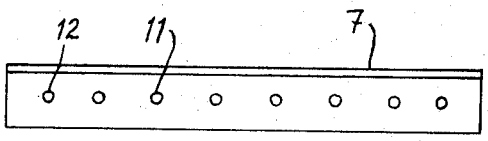
FIG. 9 shows a mounting member according to the invention.

The mounting member 7 consists of an L-shaped beam with a number of mounting holes 11, as is shown in FIG. 9. The mounting member 7 has a length which is more than half the distance between two gable beams of the package. The mounting members are connected by screws in the L-shaped mounting ears 9 of the gable beams, cf. FIG. 4. Thereupon, the two mounting members facing and overlapping each other are screwed together. The outer holes 12 of the mounting member 7 are positioned closer to the adjacent holes 11 than the distance between the remaining holes 11 of the mounting member 7, whereby it is possible to adjust the total length of the two mounting members 7 mounted together so that the width of the package will be that intended. The modular distance between the holes 11 is suitably 100 mm, while the distance between the hole 12 and the hole 11 is 90 mm.

Figure 5:
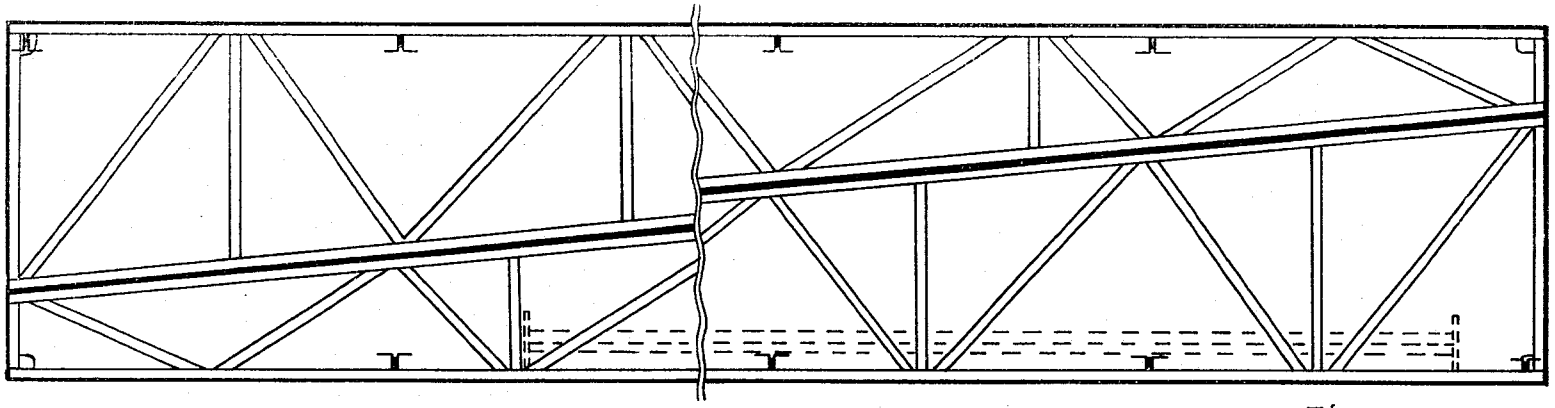
FIG. 5 is an elevation of the package according to FIG. 4.
Figure 6:
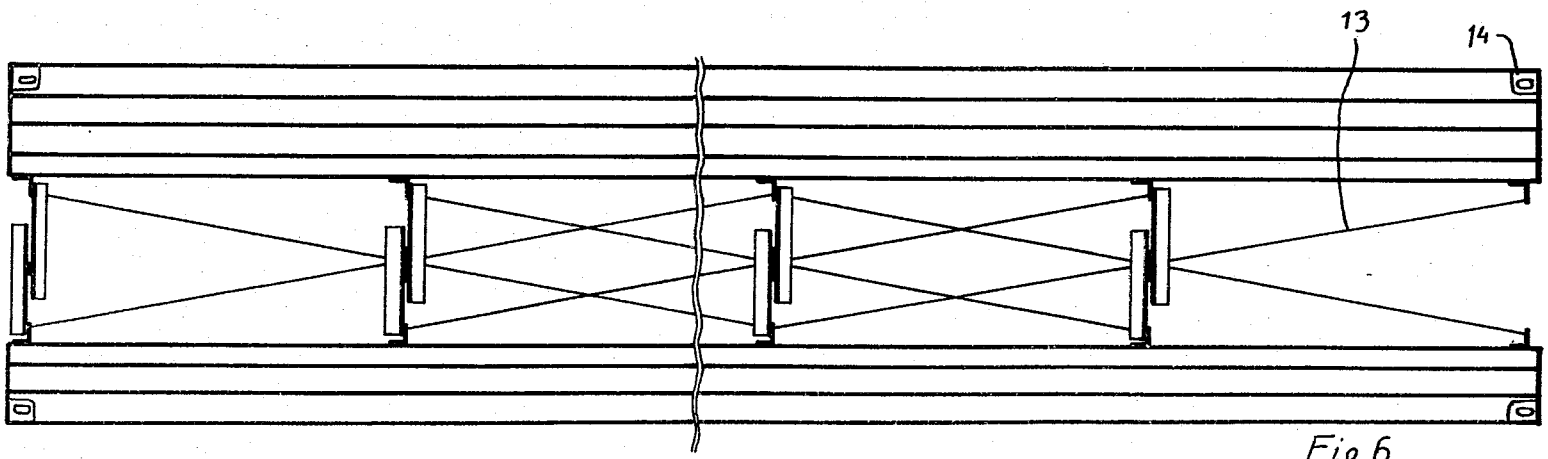
FIG. 6 is a plane view of the package according to FIG. 4.

In order to brace the package shell formed in this way, a number of diagonal braces or crosses 13 are arranged between the mounting ears 9 at both the upper and lower surface of the container, cf. FIG. 6. These diagonal braces are used to support the wall uprights in the industry hall, of. FIG. 1. FIGS. 5 and 6 show the package mounted together according to the invention in a side view and a plane view. The inner space of the container is now used to contain wall uprights 1, main uprights 3, roof plates, windows, doors, fasade plate etc. In FIG. 5 wall uprights placed on top of the mounting members 7 are indicated by dashed lines. The wall uprights are screwed together to form a unit and the unit is wedged by wood wedges or in another way secured in the package. The rest of the material is packaged and packed together in a suitable way and secured in the package.

The roof support beams 4 comprise corner mountings 14 at the corners positioned on the outside of the rectangular composite frame, cf. FIG. 6. These corner mountings form engagement members for the lifting cranes etc, which handle the package during the transport. In the industry hall the corner mounting 14 does not disturb the normal construction.

An preferred embodiment has been described above for the sake of examplification but a person skilled in the art realizes that this embodiment can be modified in many different ways within the scope of the invention as defined in the appended claims.

I claim:

1. A package for transport of components of a hall, wherein the hall comprises at least four roof support beams, four gable beams and eight mounting members; the roof support beams being interconnected in pairs and in parallel in order to form at least two rectangular composite frames; that at the upper and lower long side of each rectangular composite frame a gable beam is connected, that each gable beam comprises a number of mounting ears with mounting holes; that the mounting members consist of beams with mounting holes; that the mounting members are connected with the mounting ears of the gable beams and are transversally directed perpendicular to the rectangular composite frames; that the mounting members of two spaced parallel rectangular composite frames face and overlap each other and are interconnected in such a way that the two rectangular composite frames are positioned at a predetermined distance from each other, thereby forming the side surfaces of a rectangular container; that the dimensions of the container correspond to the dimensions according to the international regulations for a transport container; and that the said parts can be disassembled for the subsequent assembly into a hall.

2. A package for a hall according to claim 1 wherein each mounting member is an L-shaped beam and that the mounting holes are essentially equidistantly spaced, at least one hole deviating from this spacing.

3. A package for a hall according to claim 1, wherein each gable beam is mounted beside and inside the respective rectangular composite frame.

4. A package for a hall according to claim 1, wherein the roof support beams at the outer corners of the rectangular composite frame comprise corner mountings corresponding to international container standard.

* * * * *